US012487006B2

(12) United States Patent
Combs

(10) Patent No.: US 12,487,006 B2
(45) Date of Patent: Dec. 2, 2025

(54) INSULATED REGISTER BOX ASSEMBLY HAVING RADIUS CLIP DISC

(71) Applicant: STERLING CUSTOM SHEET METAL, INC., Magnolia, TX (US)

(72) Inventor: Sterling Kidd Combs, Magnolia, TX (US)

( * ) Notice: Subject to any disclaimer, the term of this patent is extended or adjusted under 35 U.S.C. 154(b) by 776 days.

(21) Appl. No.: 17/659,685

(22) Filed: Apr. 19, 2022

(65) Prior Publication Data

US 2022/0275967 A1 Sep. 1, 2022

Related U.S. Application Data

(63) Continuation-in-part of application No. 16/005,235, filed on Jun. 11, 2018, now Pat. No. 11,402,121, which is a continuation-in-part of application No. 15/439,454, filed on Feb. 22, 2017, now Pat. No. 10,309,682, which is a continuation-in-part of application No. 14/668,079, filed on Mar. 25, 2015, now Pat. No. 9,951,969.

(51) Int. Cl.
*F24F 13/08* (2006.01)
*F24F 13/02* (2006.01)
*F24F 13/32* (2006.01)

(52) U.S. Cl.
CPC ..... *F24F 13/084* (2013.01); *F24F 13/0209* (2013.01); *F24F 13/32* (2013.01)

(58) Field of Classification Search
CPC ..... F24F 13/084; F24F 13/32; F24F 2221/14; F21V 21/04; F21V 19/004; F21V 21/30; F21V 29/438; F21V 29/524; F21V 29/24; F21V 29/521; E04B 9/183; E04B 9/006; E04B 9/16; F16B 37/045; F16B 17/008
USPC ..... 454/330; 52/506.08, 306.08, 39; 248/317; 312/245, 246; 211/113
See application file for complete search history.

(56) References Cited

U.S. PATENT DOCUMENTS 3,327,606 A * 6/1967 Little ..... E04B 9/003 454/298
3,559,560 A * 2/1971 Trahan ..... F24F 13/06 248/343
3,735,951 A * 5/1973 Reed ..... E04G 3/22 248/340
3,985,158 A * 10/1976 Felter ..... F24F 13/00 52/219
4,271,751 A * 6/1981 Timmons ..... F24F 13/06 248/223.41

(Continued)

*Primary Examiner* — Steven B McAllister
*Assistant Examiner* — Frances F. Hamilton
(74) *Attorney, Agent, or Firm* — Egbert, McDaniel & Swartz, PLLC

(57) ABSTRACT

A register box assembly has a body with a pair of side walls and a duct with a flange extending inwardly from the plurality of side walls at an end opposite the duct, and a radius clip disc affixed to the body in spaced relation to the flange. The duct has a first portion extending outwardly of the plurality of side walls and second portion opening to an interior of the plurality of side walls. The radius clip disc has a portion extending outwardly of the plurality of side walls. The radius clip disc is adapted to be received in a rail. An insulating material is affixed to the plurality of side walls extends inwardly of the plurality of side walls. The radius clip disc is positioned adjacent to a corner of the body.

14 Claims, 5 Drawing Sheets

(56) References Cited

U.S. PATENT DOCUMENTS 4,406,216 A * 9/1983 Hott ..... F24F 7/013 415/213.1
4,702,087 A * 10/1987 Nakajima ..... F24F 1/0047 62/DIG. 16
4,760,981 A * 8/1988 Hodges ..... F16L 3/006 248/57
5,109,756 A * 5/1992 Barboza ..... F24F 13/062 454/284
5,281,187 A * 1/1994 Whitney, Jr. ..... F24F 13/068 248/343
5,957,506 A * 9/1999 Stepp ..... F24F 13/0263 285/47
6,488,247 B1 * 12/2002 Gonzalez ..... F24F 13/0209 248/220.1
7,108,600 B1 * 9/2006 Krzyskowski ..... F24F 13/02 454/332
7,140,960 B2 * 11/2006 Pilger ..... F24F 13/06 454/331
7,645,189 B2 * 1/2010 Pilger ..... F24F 13/06 248/57
7,980,523 B2 * 7/2011 O'Neil ..... F16M 11/22 108/42
8,517,326 B2 * 8/2013 Kelley ..... F24F 13/32 52/39
8,939,418 B2 * 1/2015 Green ..... F21S 8/026 248/200.1
9,194,602 B2 * 11/2015 Hu ..... F24F 13/20
9,790,340 B2 * 10/2017 Sobotka ..... F24F 7/00
9,982,802 B1 * 5/2018 Patterson ..... F24F 13/32
10,012,366 B2 * 7/2018 Belmonte ..... F21V 21/048
2005/0229525 A1 * 10/2005 Berlyn ..... F24F 13/32 52/506.06
2015/0204573 A1 * 7/2015 Gray ..... B32B 37/14 29/416
2016/0238163 A1 * 8/2016 Lowe ..... F16B 1/00
2017/0045259 A1 * 2/2017 Choi ..... F24F 13/1426
2017/0128869 A1 * 5/2017 Simmons ..... B01D 46/10
2018/0195757 A1 * 7/2018 Kamijo ..... F24F 13/32
2019/0032953 A1 * 1/2019 Branham ..... F24F 13/0236
2020/0340690 A1 * 10/2020 Minor ..... F24F 3/065
2021/0016119 A1 * 1/2021 Allen ..... F24F 7/04

* cited by examiner

INSULATED REGISTER BOX ASSEMBLY HAVING RADIUS CLIP DISC

CROSS-REFERENCE TO RELATED APPLICATIONS

The present application is a continuation-in-part of U.S. patent application Ser. No. 16/005,235, filed on Jun. 11, 2018, and entitled "Insulated Register Box with Boot Rail Adapter", U.S. patent application Ser. No. 16/005,235 is a continuation-in-part of U.S. patent application Ser. No. 15/439,454, filed on Feb. 22, 2017, now U.S. Pat. No. 10,309,682. U.S. patent application Ser. No. 15/439,454 was a continuation-in-part of U.S. patent application Ser. No. 14/668,079, filed on Mar. 25, 2015, now issued as U.S. Pat. No. 9,951,969.

BACKGROUND OF THE INVENTION

1. Field of the Invention

The present invention relates to ductwork for heating, ventilation and air-conditioning (HVAC) systems. More particularly, the present invention relates to register boxes as used with such systems. Additionally, the present invention relates to boot cleats or drive cleats that are used to secure the register box to supporting surfaces.

2. Description of Related Art Including Information Disclosed Under 37 CFR 1.97 and 37 CFR 1.98

To create the desired ambient conditions within a structure, a typical HVAC system is installed for circulating and/or conditioning air drawn from the interior of the structure and returned to the interior of the structure. A central unit or several units are located in or near the structure, each unit comprising a fan for air circulation and optionally comprising a heating, humidification, or cooling system for conditioning the air passing through the central unit.

To conduct air to and from each central unit, ducting is provided in the structure. The ducting includes supply-air ducts which provide conditioned air to the interior of the structure and are connected to the outlets of each central unit and return-air ducts which return air to each central unit and are connected to inlets of each central unit. Supply-air ducts typically terminate in supply-air register boxes mounted to the walls, the ceilings, or other surfaces within the interior, whereas return-air ducts typically begin at register boxes mounted to a surface within the interior, such as a wall, ceiling, or floor. There are usually many more register boxes for supplying air than for returning air, with those for returning air typically being substantially larger than those for supplying air.

To increase efficiency, building codes are being revised to require substantially airtight HVAC systems. In the past, a standard technique has been utilized for forming such sheet-metal register boxes. A form is cut from a rectangular, planar metal sheet. The form has cutouts for corners or other features to allow bending of the form into the desired shape. Cutouts define the height of the sides and an overlapping flap is formed by cutting a slot at each cut out. The sides are bent along bend lines to lie in intersecting planes so as to form an open-bottom, rectangular enclosure of a register box, with the vertical edges of the sides abutting the inside surfaces of the sides. The flap is folded around each corner that lies adjacent the outer surface of the side and then fastened to the side with rivets. In order to complete the register box, a circular duct connector or is connected to a circular cutout in the upper surface of the box. Prior art register boxes are also formed with abutting edges to form the enclosure. The abutting or overlapping edges may be fastened by adhering or by other fastening means, such as spot welding.

The method described above produces ducting enclosures that often leak conditioned air through the gaps between the edges at the corners, or, in the case of enclosures formed with multiple pieces, through the seams where the pieces are joined together. The prior-art method includes many labor-intensive steps to form the enclosures, including the cutting of the planar sheet and the fastening of the edges.

In order to achieve the requisite efficiency in compliance with building codes, insulation is used with such register boxes. The formation of the insulation of the register boxes has become somewhat of a problem. Since the boxes are conventionally made of sheet metal, such as galvanized steel or aluminum, the insulation must be applied to either or both the inside and outside of the register box either before or after it is installed. The cutting and fastening of the insulation to the box is tedious and time-consuming. As such, it is thereby rather expensive in terms of the cost of the insulation material and in terms of the amount of time required to properly insulate the register box.

The placement of insulation can be a time-consuming, hazardous, and tedious task. Typically, a large section of fibrous material requires a cutting into various shapes that fit within the interior of the register box. This fibrous material is then affixed to the walls on the inside of the register box by hand. Often, many steps are required so as to properly fit the insulation material within the register box. Furthermore, since fibrous material is being manually handled by workers, there can be exposure to airborne fibers. The cutting and fitting of the insulation material within the register box is extremely tedious and boring to workers.

In the past, various patents have issued relating to register boxes and to the insulating of such register boxes. For example, U.S. Pat. No. 3,985,158, issued on Oct. 12, 1976 to J. V. Felter, describes a box for mounting diffusers wherein the main body of the box is made of expanded plastic or similar material. One or more connection elements are molded within the walls of the box to provide for connection of the box to the building structure and to a duct and also to reinforce the box.

U.S. Pat. No. 4,735,235, issued on Apr. 5, 1988 to Anderson et al., discloses an insulated duct end system. The system includes duct assemblies and transition components for interconnecting the duct assemblies. Each duct assembly includes an insulated duct having a rigid sleeve within at least one end. Each sleeve includes an abutment ring and orifices in the ring for permitting air to flow into the insulated area to balloon the layer and improve its insulative effect.

U.S. Pat. No. 5,095,942, issued on Mar. 17, 1992 to G. C. Murphy, teaches a plastic self-insulating ductwork system. The system includes a distribution box which includes an upper portion having a plurality of walls and a bottom plate. The distribution box is joined to interconnecting duct lines by adapter conduits. The adapter conduits are adapted at one end for connection to an opening in the wall and are adapted at the other end for connection to an adjoining duct line. U.S. Pat. No. 5,219,403, issued on Jun. 15, 1993 the G. C. Murphy, discloses a similar type of self-insulating ductwork system as that of U.S. Pat. No. 5,095,942.

U.S. Pat. No. 5,658,196, issued on Aug. 19, 1997 to T. L. Swaim, provides an air duct diffuser for attachment to a ceiling grid. The diffuser includes a frame which mounts to the ceiling grid and a louver which mounts to the frame for directing diffused air within an associated airspace. A preformed composite housing of insulating material mounts to the frame and has punch-out duct openings of varying sizes.

U.S. Pat. No. 5,749,190, issued on May 12, 1998 to S. R. Williams, shows an HVAC register box having no welded or riveted corners and also a process for making such an HVAC register box. The register box is fabricated from a single sheet of material without cutting. The register box has superior rigidity and resistance to air leakage at the joints or corners.

U.S. Pat. No. 5,957,506, issued on Sep. 28, 1999 to M. D. Stepp, provides a sheet-metal insulated register box. The register box has an adjustable elbow fitting that is coupled directly to an air inlet panel of an air distribution register box by having roll-formed flange portions that are mated in interlocking, overlapping engagement with each other. The air inlet panel includes an outwardly flared coupling flange bordering an air inlet opening. The neck of the sheet-metal elbow includes a folded coupling flange that is dimensioned for interfitting, overlapping engagement with the outwardly-flared elbow coupling flange.

U.S. Patent Publication No. 2008/0014860, published on Jan. 17, 2008 to Heitman et al., discloses a method and apparatus for eliminating register boxes. A collar plate assembly interfaces with metal air ducts and is provided with at least one spring indentation ring to accept two or more locking springs. The locking springs are used to attach the ceiling register to the collar plate assembly. The collar plate assembly uses mounting rails that attach the assembly to either the ceiling or wall supports. A trim ring is inserted in the cutout that attaches between the collar in the ceiling so as to eliminate air leakage and so as to provide an essentially smooth flow of air from the supply duct to the inside of the structure.

U.S. Patent Publication No. 2004/0130154, published on Jul. 8, 2004 to Stepp et al., shows a substantially airtight register box for HVAC systems. The register box has a body formed from at least one planar sheet. The body has an inlet and outlet. At least one of the inlet and the outlet is formed by folding corners of the planar sheet to form planar sides that lie in intersecting planes. The enclosure is then mounted to a surface of an interior area of a structure and is connected to ducts for communicating air between the interior area at a central air-handler unit.

U.S. Patent Publication No. 2008/0045137, published on Feb. 21, 2008 F. Rosal, discloses an insulated plenum box for heating, ventilating and air conditioning duct systems. This plenum box has insulation sprayed onto either the inside or outside of the plenum box in order to match the R-value of the connecting insulated duct.

The configuration of the ductwork poses a problem for unskilled construction workers and is extremely time-consuming. Generally, this work involves fitting together preformed components that frequently differ in dimensions and require careful measuring and positioning during the installation process so that the components fit together. For example, a worker will commonly transpose the dimensions of the register box onto the area of the wall or ceiling opening to ascertain the dimensions of the opening to be cut. Alternately, the worker will select a standard-sized commercially available register box to fit into a pre-existing opening. Because any measurements can introduce inaccuracies, the possibility that the components will not fit together to provide support for the register box in the wall or ceiling opening or create gaps between the edges of the opening in the register box is a real concern. In those cases, another bracket must be brought to the site and used. Alternatively, the register box must be modified or register box replaced with a different size so that the components fit together and so that the register box is securely supported in the opening in the wall or ceiling.

In the past, various patents have issued with respect to boot rail adapters. For example, U.S. Pat. No. 4,760,981, issued on Aug. 2, 1988 to B. E. Hodges, discloses a boot hanger assembly. This hanger assembly supports ductwork. The hanger assembly has telescoping brackets for supporting the ductwork and a clip. The clip is adapted to slidably receive the telescoping hanger brackets. The clip is also adapted to mount the ductwork to the hanger brackets in a slidable fashion.

U.S. Pat. No. 6,652,375, issued on Nov. 25, 2003 to W. J. Donnelly, shows an air-conditioning register and boot assembly. A register mounting member is detachably connected to the boot member and a register face member is mounted on the mounting member to cover the front face thereof. The assembly is quickly and conveniently installed an opening in a floor, wall or ceiling by flexible securing clips mounted on upper edges of side or end walls of the mounting member. The securing clips have gripping formations which engage with similar formations on the face member to assist in retaining the face member to the mounting member.

U.S. Pat. No. 6,866,579, issued on Mar. 15, 2005 to A. Pilger, describes a boot hanger mounting bracket that includes a boot hanger frame portion and a supporting member portion. The boot hanger mounting bracket is formed of a sturdy yet bendable material so that it can be configured and adjusted on-site. The boot hanger mounting bracket is secured to the building structure by securing a pair of boot hanger arms to the ceiling joists, wall studs or other supporting surface.

U.S. Pat. No. 8,944,397, issued on Feb. 3, 2015 to Brown et al., teaches a universal HVAC component mounting system. The mounting system defines a platform comprised of slidingly engaging rail sections. Each of the rail sections includes support brackets from which extend a receiving member or an inserting member configured to engage a receiving member. The platform sections include arms having channels and arms having glides. Each glide is configured to slidingly engage the channel of an adjacent platform section so as to allow the platform sections to adjust the effective length and width of the platform.

U.S. Patent Application Publication No. 2003/0177724, published on Sep. 25, 2003 to W. A. Botting, provides an adapter having a central body portion and a mount for connection to each of an HVAC register cover and a duct-engaging boot. A surface of the central body portion includes mounting apertures in which each is configured to accept a fastener so that the central body portion can be mounted to a support structure, such as a ceiling joist. The adapter includes a register cover mounting surface that is adjustable so that it can accommodate different-sized register covers. The adapter also includes a boot mounting surface coupled to the register cover mounting surface such that, upon engagement between the register cover mounting surface and the register cover and upon engagement between the boot mounting surface and the boot, fluid communication between the boot and the register cover is established.

U.S. Patent Application Publication No. 2005/0034407, published on Feb. 17, 2005 to Snyder et al., provides a support frame for a duct so as to hold the position of a vertically-disposed air duct within a wall between wall studs. The support frame defines an opening that receives the air duct. The support frame has a flange extending around the opening that engages the air duct. The support frame may include notched ends that receive the opposed wall studs to position the support frame with respect to the duct opening formed in the floor boards.

U.S. Pat. No. 10,648,695, issued on May 12, 2020 to the present Applicant, describes an insulated register box with a boot rail adapter. This insulated register box includes an insulating material affixed within the register box, a rail guide affixed to a side panel of the register box, and a rail having a section received in a slot of the guide rail. The rail is adapted to be affixed to a supporting surface, such as a joist. The rail guide is slidable relative to the rail. The rail guide is affixed to an exterior surface of the side panel.

U.S. Patent Application Publication No. 2018/0320921, published on Nov. 8, 2018 to the present Applicant, describes another type of insulated register box with boot rail adapter. This assembly includes a register box, an insulating material affixed within the register box, a rail affixed to a side panel of the register box, and a rail guide having a slot that receives a section of the rail therein. The rail guide is adapted to be affixed to a supporting surface. The rail is affixed to at least one of the side panels of the register box. The rail is slidable relative to the rail guide. The register box has a plurality of side panels and a duct that opens to an interior of the plurality of side panels. The insulating material extends inwardly of the plurality of side panels.

In prior U.S. Pat. No. 10,648,695 and prior U.S. Patent Application Publication No. 2018/0320921, the rails and/or rail guides would be placed on surfaces arranged parallel to each other. It was found that many times, the supporting surfaces would, in fact, not be parallel to each other. Under those circumstances where the supporting surface are in non-parallel relation, the rails and rail guides of this prior patent and patent application publication would not be easily adaptable thereto. Additionally, the register box could only be assembled onto the rail and rail guide lengthwise or widthwise. As such, a need developed so as to create such a register box which is adaptable to non-parallel surfaces and which can be installed either in a lengthwise or widthwise configuration.

It is an object of the present invention to provide an insulated register box which minimizes air loss.

It is another object of the present invention to provide an insulated register box which improves the insulating rating of the register box.

It is another object of the present invention to provide a insulated register box in which the register box is fire-resistant.

It is another object of the present invention to provide an insulated register box which is compliant with national building codes.

It is another object of the present invention to provide an insulated register box which avoids the use of fibrous insulation.

It is a further object of the present invention to provide an insulated register box which improves the health and safety of workers that assemble the register box.

It is another object of the present invention to provide an insulated register box in which the formed register box is very energy efficient.

It is another object of the present invention to provide a process for forming a register box which allows inspectors to quickly ascertain that the register box is insulated.

It is another object of the present invention to provide an insulated register box with a rail adapter which allows the position of the register box to be adjusted.

It is another object of the present invention to provide an insulated register box with a rail adapter which allows the register box to be locked in position on the rails.

It is another object of the present invention to provide an insulated register box and a rail adapter which avoids the penetration of the material of the register box.

It is still another object of the present invention to provide an insulated register box with a rail adapter which can be quickly and easily assembled by unskilled personnel.

It is still a further object of the present invention to provide an insulated register box with a rail adapter which is easy to manufacture and relatively inexpensive.

It is a further object of the present invention to provide an insulated register box that it is adaptable to be secured to non-parallel supporting surfaces.

It is still further object of the present invention to provide an insulated register box that can accommodate a sliding motion in a lengthwise or widthwise direction.

These and other objects and advantages of the present invention will become apparent from a reading of the attached specification and appended claims.

BRIEF SUMMARY OF THE INVENTION

The present invention is a register box assembly that comprises a body having a plurality of side walls, a duct, a flange extending inwardly from the plurality of side walls at an end of the body opposite the duct, and a radius clip disc affixed. The duct has a first portion extending outwardly of the plurality of side panels and a second portion opening to an interior of the plurality of side walls. The radius clip disc has a portion extending outwardly of the plurality of side walls. The radius slip disc will be in slightly spaced relation to the flange and will extend in parallel planar relation to the flange. The radius clip disc is adapted to be received in a rail. An insulating material is affixed to the plurality of side walls and extends inwardly of the plurality of side walls. The radius clip disc is positioned adjacent to a corner of the body.

The body has an end wall formed opposite to the flange. The duct is positioned so as to extend through an opening in the end wall. The insulating material is affixed to the end wall and bears against the second portion of the duct. A rod has one end affixed to the radius clip disc and an opposite end affixed to the end wall. The rod extends through the insulating material. The radius clip disc has a circular configuration. The body has a panel extending outwardly in transverse relation to the flange. The radius clip disc is positioned exteriorly of the panel.

In the preferred embodiment of the present invention, the plurality of side walls comprises four side walls arranged in a square or rectangular configuration. The flange comprises four flanges extending inwardly respectively of the four side walls so as to define a square or rectangular opening. The insulating material bears against the four side walls and against the four flanges. The radius clip disc comprises four radius clip discs respectively affixed to the four flanges or at seams between adjacent flanges of the four flanges.

The register box assembly of the present invention includes at least one rail having an interior passageway. The radius clip disc is received in this interior passageway. The rail has a slot extending longitudinally therealong. The slot opens to the interior passageway. The radius clip disc has a rod affixed thereto. This rod extends through the slot. In one embodiment, the at least one rail comprises a pair of rails extending in parallel relation to each other. The radius clip disc comprises at least two radius clip discs respectively received in the pair of rails. In alternative embodiment of the present invention, the at least one rail comprises a pair of rails extending in non-parallel relation. The radius clip disc includes at least two radius clip discs respectively received in the pair of rails. In this alternative embodiment, there can also be another pair of rails extending in parallel relation to each other. The radius clip disc would then include another two radius clip discs respectively received in another pair of rails.

In the present invention, the radius clip discs are greatly adaptable. If the supporting surface includes joists that are arranged in parallel relation, the insulated register box of the present invention can be secured to the boot or drive cleats on the joists. In other circumstances, where the joists are in non-parallel relation, the radius clip disc can be joined to the rail in a proper manner even though the supporting surface surfaces are non-parallel. In other circumstances, the use of the radius clip discs allow the insulated register box to be moved in a lengthwise direction or in a widthwise direction. As such, if the supporting surface is directed to the width dimension of the register box, the register box can slide along the rails in the widthwise direction. As such, the present invention avoids those circumstances where the buyer must specify whether the register box has lengthwise or widthwise rails.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
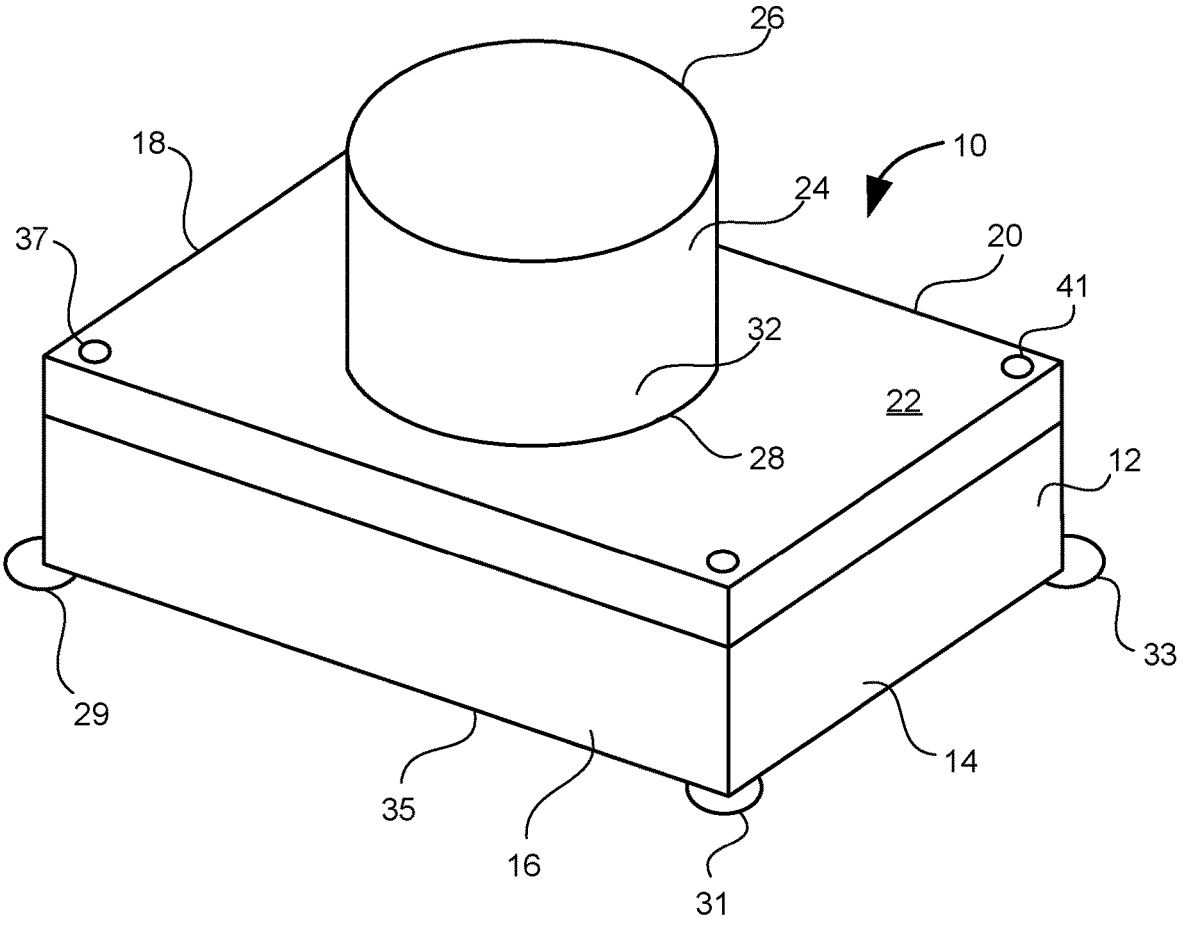
FIG. 1 is an upper perspective view showing the insulated register box assembly of the present invention.

Referring to FIG. 1, there shown the insulated register box 10 of the present invention. The register box 10 includes a body 12 having side walls 14, 16, 18 and 20 formed into a generally rectangular or square configuration. A wall 22 extends across this generally rectangular configuration. A duct 24 is illustrated as affixed to wall 22 so as to open to the interior of the plurality of side walls 14, 16, 18 and 20 and to the interior of the body 12. The duct 24 includes an open end 26 so as to allow duct 24 to be connected to the HVAC system of a building.

Conventionally, the register box 10 will be formed and pieced together through the use of tack or spot welding. Tack or spot welding is a very efficient manner of forming the register box. As will be described hereinafter, an expandable polymeric material, such as polyurethane, is applied for the purposes of insulating the interior of the body 12.

FIG. 1 shows that there are a plurality of radius clip discs 29, 31 and 33 affixed to the bottom 35 of the body 12. Radius clip discs 29, 31 and 33 have a generally circular configuration and have a portion that extends outwardly of the plurality of side walls 14, 16, 18 and 20. The radius clip discs 29, 31 and 33 are adapted to be received by rails located on a supporting surface. Radius clip disc 29 is generally positioned at the corner defined by side walls 16 and 18. Radius clip disc 31 is positioned at a corner defined by the side walls 14 and 16. Radius clip disc 33 is positioned at a corner defined by the side walls 14 and 20. There will be another radius clip disc (not shown) at the corner defined by side walls 18 and 20. As will be described hereinafter, a rod will extend through the body 12, and the insulating material therein, so as to connect with the radius clip discs 29, 31 and 33. FIG. 1 shows rod ends 37, 39 and 41 as spot welded to the exterior surface of the end wall 22. As will be described, each of the radius disc clips 29, 31 and 33 will be spaced by a small distance from the bottom 35 of the body 12. The spacing serves to allow the rail to be positioned over the radius clip discs 29, 31 and 33.

Figure 2:
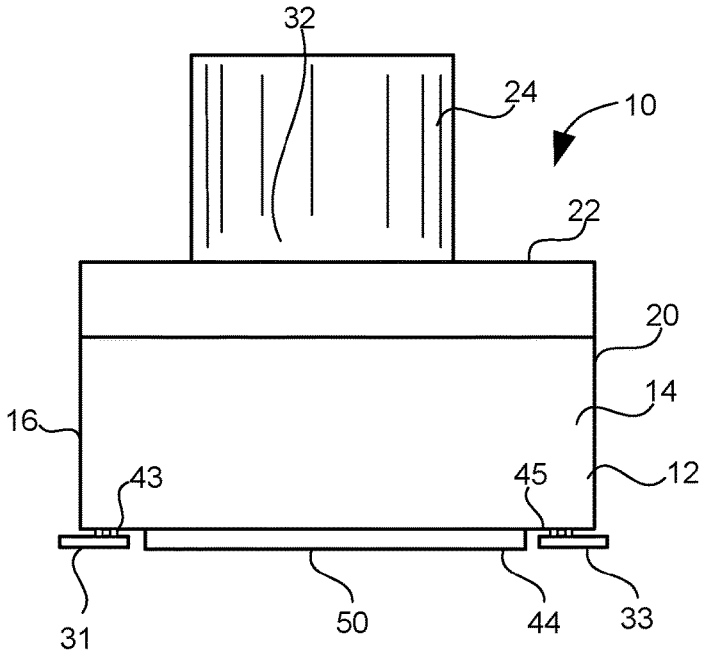
FIG. 2 is an end view of the insulated register box assembly of the present invention.

FIG. 2 shows a side view of the register box 10. The register box illustrates has the side wall 14 particularly illustrated. The duct 24 is illustrated as affixed to and extending outwardly of the end wall 22. It can be seen that there are flanges 43 and 45 that extend inwardly from the respective side walls 16 and 20 at the bottom of the body 12 of the register box 10 opposite the end wall 22 and opposite the duct 24. There is a panel 44 that extends outwardly from the ends of the flanges 43 and 45. Panel 44 defines an aperture 50 opening to the interior of the body 12. This aperture will have a square or rectangular configuration.

FIG. 2 particularly illustrates the arrangement of the radius disc clips 31 and 33. Radius disc clip 31 is positioned so as to have a portion extending outwardly of the walls 14 and 16. The radius disc clip 31 is located outwardly of the panel 44. The radius disc clip 31 will be spaced by small distance from the flange 43. Similarly, radius disc clip 33 will have a portion extending outwardly of the side walls 14 and 20. Radius disc clip 33 is also located at an exterior of the panel 44. The radius disc clip 33 will be spaced a small distance from the flange 45.

Figure 3:
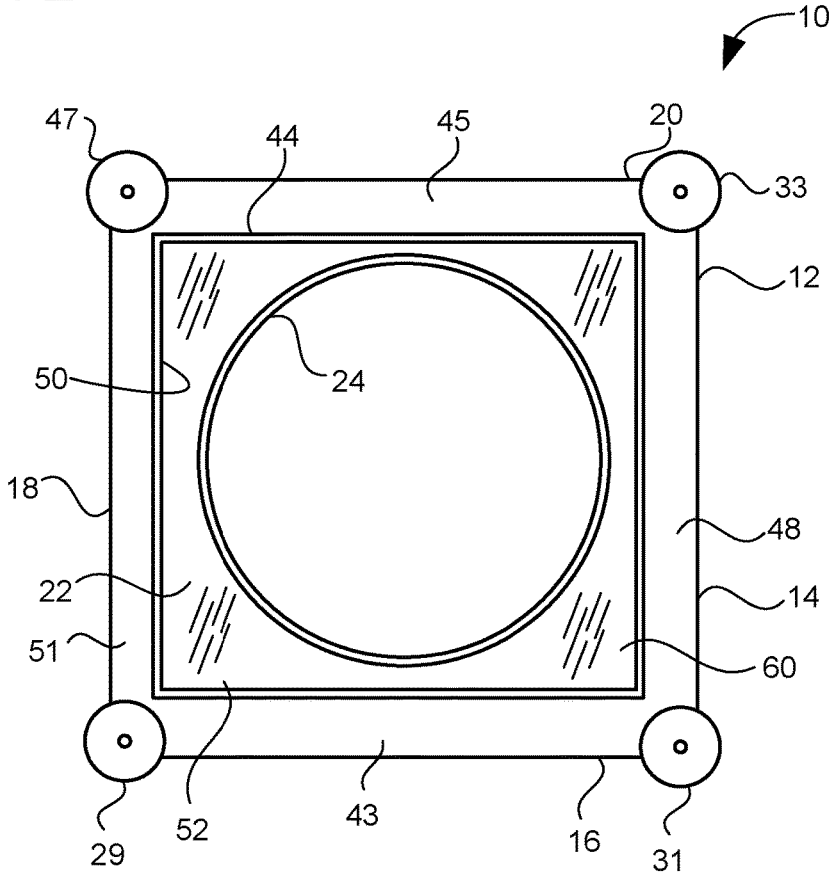
FIG. 3 is a bottom view of the insulated register box assembly of the present invention.

FIG. 3 is a bottom view of the register box 10 of the present invention. In FIG. 3, it can be seen that the duct 24 is affixed to the end wall 22. End wall 22 includes a surface 52 that extends from the opening of the duct 24 to the side walls 14, 16, 18 and 20 of the body 12. In FIG. 3, the expanded polymeric material 60 resides over the surface 52 and extends to the side walls 14, 16, 18 and 20. As such, the expanded polymeric material 60 effectively insulates the wall 22 in the area adjacent to the opening of the duct 24.

FIG. 3 further shows the nature of the flanges 43, 45, 48 and 51. Flanges 43, 45, 48 and 51 extend around the interior of the body. Flange 43 extends inwardly transverse to side wall 16. Flange 45 extends inwardly transverse to the side wall 20. Flange 48 extends inwardly in transverse relation to the side wall 14. Flange 51 extends inwardly in transverse relation to the side wall 18. The expanded polymeric material 60 will reside against the interior surface of these flanges. The panel 44 is illustrated as extending from the inner edge of each of the flanges 43, 45, 48 and 51 so as to define the aperture 50.

In FIG. 3, it can be seen that the radius clip disc 29 is positioned at the corner between the flanges 43 and 51. Radius clip disc 31 is located at the corner defined by the flanges 43 and 48. Radius clip disc 33 is located at the corner defined by the flanges 45 and 48. Radius clip disc 47 is located at the corner defined by the flanges 51 and 45. Each of the radius clip discs 29, 31, 33 and 47 has a circular configuration.

Figure 4:
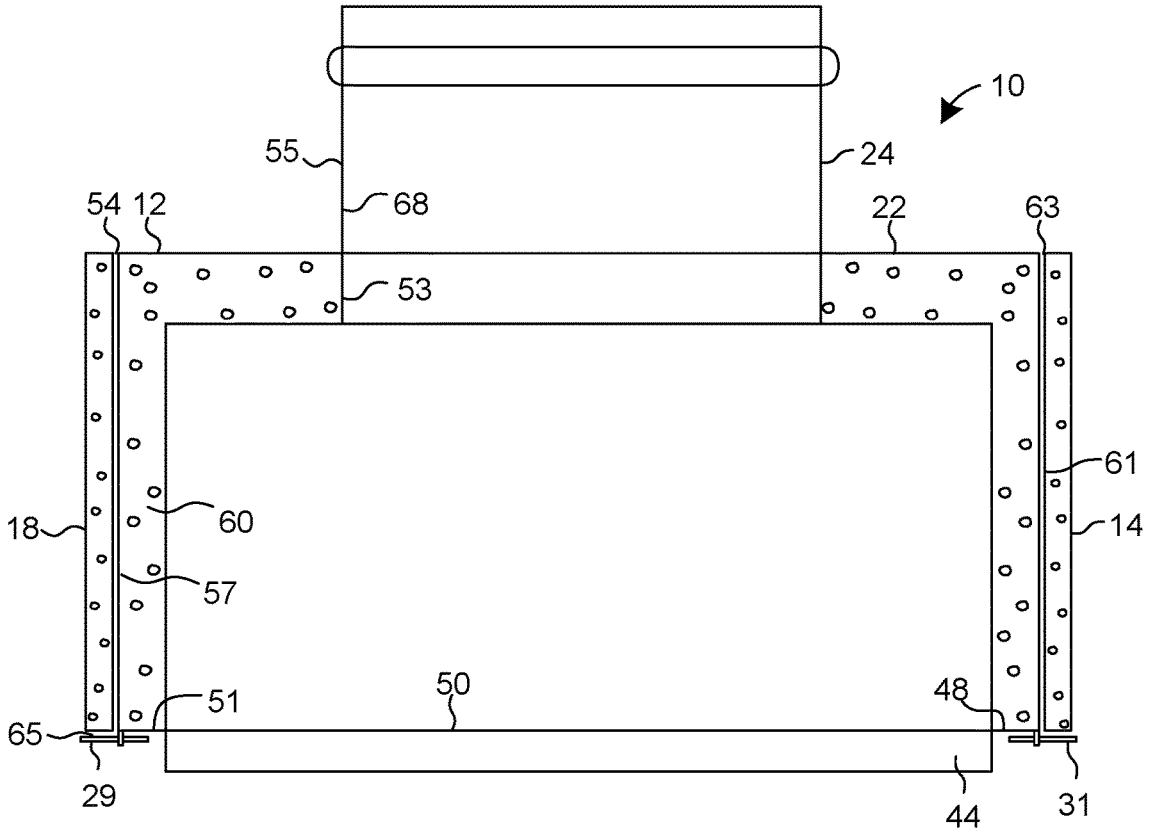
FIG. 4 is a cross-sectional view of the insulated register box assembly of the present invention.

FIG. 4 is a cross-sectional view of the register box assembly 10 of the present invention. As can be seen in FIG. 4, the expanded polymeric material 60 is illustrated as positioned against the side walls 14 and 18. A similar configuration will occur with respect to the walls 16 and 20. The expanded polymeric material 60 is illustrated as having a thickness approximately equal to the width dimension of the flanges 48 and 51. The expanded polymeric material 60 also has a portion that resides against the inner surface of the end wall 22. The expanded polymeric material 60 will extend so as to bear against a portion 53 of the duct 24. Portion 53 of duct 24 extends into the interior of the body 12. The duct 24 has another portion 55 that extends outwardly of the end wall 22 and outwardly of the body 12.

In this configuration, the expanded polymeric material 60 can serve as insulation. This insulation is compliant with national building codes, is fire resistant, and also avoids the use of fibrous insulation material. As such, this type of material, since it avoids the fibrous material and the assembly requirements, improves the health and safety of workers that assemble the register box assembly 10. The insulation created by the expanded polymeric material 60 does not require any alterations in the structure of the body 12 or of the duct 24. The insulation material causes the register box assembly 10 to be very energy efficient.

In FIG. 4, it can be seen that there is no expanded polymeric material located on the inner wall 68 of the duct 24. If any expanded polymeric material would enter the duct 24 or reside on the inner wall 68 of the duct 24, it could hamper air circulation. As such, it was felt that it was important to block any movement of the expanded polymeric material from entering the area on the interior of the duct 24. Since the expanded polymeric material 60 extends to the aperture 50 defined by the wall 14 and the various flanges, it does not interfere with air flow into the interior of the register box. As such, the present invention remain substantially aerodynamic while, at the same time, improves the insulating qualities required of the register box 10.

In FIG. 4, there are radius clip discs 29 and 31 positioned in spaced relation to the flanges 51 and 48, respectively. A rod 57 extends from radius clip disc 29 through the insulation 60 to the end wall 22. The end 59 of the rod 57 can be spot welded to the end wall 22. Similarly, the radius clip disc 31 is in slightly spaced relation to the flange 48. A rod 61 is affixed to the radius clip disc 31 and extends through insulation 60 so as to have an end 63 emerging at the end wall 22. End 63 can also be spot welded to the end wall 22. Each of the rods 57 and 61 are arranged in air-tight relationship within the expanded polymeric material 60. The rods 57 and 61 can be installed prior to or subsequent to the introduction of the expanded polymeric material 60 into the interior of the body 12 of the insulated register box assembly 10. There is a small space 65 located between the radius clip disc 29 and the flange 51. A similar space occurs with respect to the radius clip disc 31 and the flange 48. The space 65 allows the radius clip discs 29 and 31 to be inserted into an appropriate rail assembly.

Figure 5:
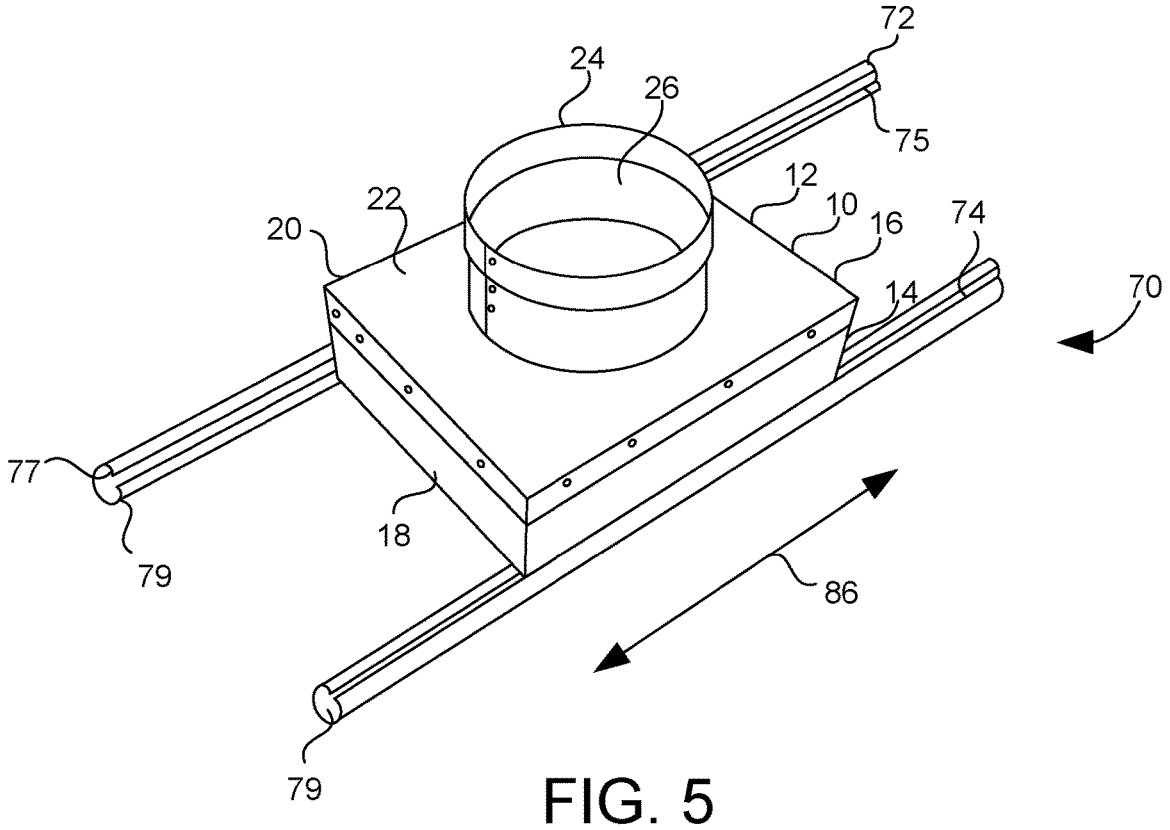
FIG. 5 is an upper perspective view showing the insulated register box assembly of the present invention as secured to a pair of rails.

FIG. 5 shows the rail assembly 70 as secured to the register box assembly 10. The register box assembly 10 has a body 12 with side walls 14, 16, 18 and 20. The body 12 is formed into a generally square or rectangular configuration. The end wall 22 extends across this generally square or rectangular configuration. The duct 28 includes an open end 26 so as to allow the duct 24 to be secured to the HVAC system of a building. The rail assembly 70 includes a first boot or drive cleat 72 and a second boot or drive cleat 74. The boot or drive cleat 72 has a slot 75 formed therethrough and extending longitudinally therealong. As such, the boot or drive cleat 72 has an interior passageway 77 formed therein. A similar arrangement occurs with respect to the boot or drive cleat 74. The boot or drive cleats 72 and 74 include a lower surface 79 that allows the cleats to be affixed to supporting surfaces, such as joists. The insulated register box assembly 10 is secured to the boot or drive cleats 72 and 74 by inserting the perspective radius clip discs into the open end of the cleats such that the respective rods will extend through the slot 75. As such, the body 12 can slide so as to be positioned in any desired location along the length of the boot or drive cleats 72 and 74.

Figure 6:
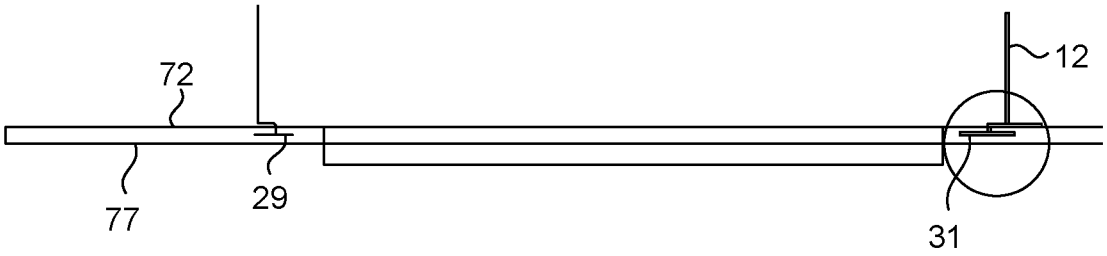
FIG. 6 is a cross-sectional view showing they placement of the radius clip discs within the rails.

FIG. 6 shows how the radius disc clips 29 and 31 are received within the boot or drive cleats 72. In particular, the radius disc clips are received in the interior passageway 77 of the boot or drive cleat 72. As such, this allows the body 12 to slide in a lengthwise or a widthwise direction, such as shown by the arrow 86 in FIG. 5.

Figure 7:
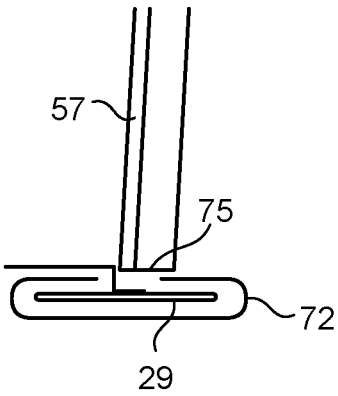
FIG. 7 is an end view showing the placement of the radius clip disc within the interior of the rail.

FIG. 7 shows the radius disc clip 29 as affixed to the rod 57 so as to extend through the slot 75 of the boot or drive cleat 72. The radius disc clip can be fixed in non-rotatable relationship to the end of the rod 57. However, in other circumstances, and within the scope of the present invention, this radius disc clip 29 can be mounted so as to be rotatable. The use of a non-rotatable radius disc clip greatly simplifies the assembly of the register box assembly of the present invention.

Figure 8:
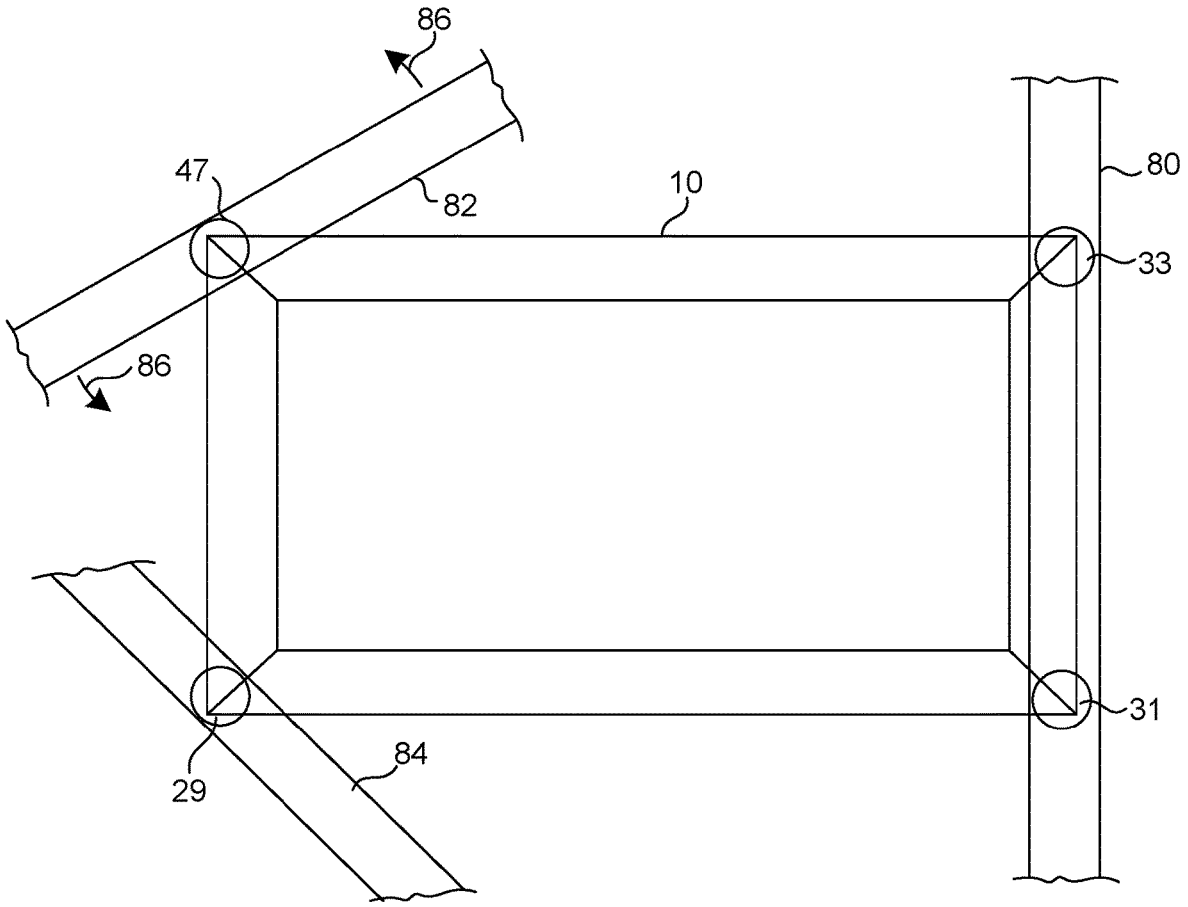
FIG. 8 is an plan view showing the securing of the insulated register box assembly with rails in non-parallel relation.

FIG. 5 shows the insulated register box assembly 10 as applied to the rails that were arranged in parallel relationship. However, importantly, the radius disc clip of the present invention, as mounted at the corners of the body 12 of the insulated register box assembly 10 allows the insulated register box assembly to be mounted to rails and supporting structures that are in non-parallel relationship. FIG. 8 illustrates that the radius disc clips 31 and 33 are received within a rail 80. The radiused disc clips 29 and 47 are received within rails 82 and 84. Rails 82 and 84 are in non-parallel relationship to each other and in non-parallel relationship to rail 80. If necessary, the rails 82 and 84 can be rotated to any desired position for securing to the underlying surface while still maintaining the insulated register box assembly 10 within the particular rail. This is illustrated by the arrows 86 in FIG. 8. As such, this greatly improves the flexibility and adaptability of the present invention to various underlying support structures. As stated herein previously, with the installation of the radius disc clips of the present invention, one no longer has to make one set of rails and clips for use in association with structures wherein the insulated register box moves either lengthwise or widthwise. Additionally, if the underlying support structures are in non-parallel relationship, the radius disc clip allows the structure of the present invention to be adapted to these non-parallel support structures.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A register box assembly comprising:

a body having a plurality of side walls and a duct, the duct having a first portion extending outwardly of the plurality of side walls and a second portion opening to an interior of the plurality of side walls, said body having a flange extending inwardly from the plurality of side walls at an end opposite the duct;

a radius clip disc affixed to said body, said radius clip disc having a portion extending outwardly of a side wall of the plurality of side walls, said radius clip disc adapted to be received in a rail, said radius clip disc being planar and circular, said radius clip disc positioned adjacent to a corner of said body in spaced parallel relation to the flange; and the rail comprising at least one rail having an interior passageway, said radius clip disc received in the interior passageway, the at least one rail having a slot extending longitudinally therealong, the slot opening to the interior passageway; and said radius clip disc having a rod affixed thereto, the rod extending through the slot when said radius clip disc is received in the interior passageway of said at least one rail.

2. The register box assembly of claim 1, said body having a panel extending outwardly in transverse relation to the flange, said radius clip disc positioned outwardly of the panel.

3. The register box assembly of claim 1, said at least one rail comprising a pair of rails extending in parallel relation to each other, said radius clip disc comprising at least two register radius clip discs respectively received in the pair of rails.

4. The register box assembly of claim 1, said at least one rail comprising a pair of rails extending in non-parallel relation, said radius clip disc comprising at least two radius clip discs respectively received in the pair of rails.

5. The register box assembly claim 4, said at least one rail comprising another pair of rails extending in parallel relation to each other, said radius clip disc comprising another two radius clip discs respectively received in the another pair of rails.

6. The register box assembly of claim 1, further comprising:

an insulating material affixed to the plurality of side walls and extending inwardly of the plurality of side walls.

7. The register box assembly of claim 6, said body having an end wall formed opposite to the flange, the duct positioned so as to extend through an opening in the end wall, said insulating material affixed to the end wall and bearing against the second portion of the duct.

8. The register box assembly of claim 7, further comprising:

a rod having one end affixed to said radius clip disc and an opposite end affixed to the end wall, said rod extending through said insulating material.

9. The register box assembly of claim 6, the plurality of side walls comprising four side walls arranged in a square or rectangular configuration, the flange comprising four flanges extending inwardly respectively of the four side walls so as to define a square or rectangular opening, said insulating material bearing against the four side walls and against the four flanges.

10. The register box assembly of claim 9, said radius clip disc comprising four radius clip discs respectively affixed to the four flanges or at seams between adjacent flanges of the four flanges.

11. A register box assembly comprising:

a body having a pair of side walls and a duct, the duct having a first portion extending outwardly of the plurality of side walls and a second portion opening to an interior of the plurality of side walls, said body having a flange extending inwardly from the plurality of side walls at an end opposite the duct;

a radius clip disc affixed to said body, said radius clip disc having a portion extending outwardly of at least one wall of the plurality of side walls, said radius clip disc being planar and circular, said radius clip disc positioned adjacent to a corner of said body in spaced parallel relation to the flange;

an insulating material affixed to the plurality of side walls and extending inwardly of the plurality of side walls, said body having an end wall formed opposite to the flange, the duct positioned so as to extend through an opening in the end wall, said insulating material affixed to the end wall and bearing against the second portion of the duct; and at least one rail having an interior passageway, said radius clip disc received in the interior passageway, said at least one rail having a slot extending longitudinally therealong, the slot opening to the interior passageway, said radius clip disc having a rod affixed thereto, the rod extending through the slot.

12. The register box assembly of claim 11, further comprising:

the rod having one end affixed to said radius clip disc and an opposite end affixed to the end wall, said rod extending though said insulating material.

13. The register box assembly of claim 11, said at least one rail comprising a pair of rails extending in parallel relation to each other, said radius clip disc comprising at least two radius clip discs respectively received in the pair of rails.

14. The register box assembly of claim 11, said at least one rail comprising a pair of rails extending in non-parallel relation, said radius clip disc comprising at least two radius clip discs respectively received in the pair of rails.

* * * * *